US008464913B2

(12) United States Patent
Yoon

(10) Patent No.: US 8,464,913 B2
(45) Date of Patent: Jun. 18, 2013

(54) DETERGENT CONTAINER CRADLE FOR APPLYING PRESSURE TO THE CONTAINER

(75) Inventor: Jong Sun Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 336 days.

(21) Appl. No.: 12/860,718

(22) Filed: Aug. 20, 2010

(65) Prior Publication Data

US 2011/0049314 A1 Mar. 3, 2011

(30) Foreign Application Priority Data

Aug. 31, 2009 (KR) ..... 10-2009-0081090
Aug. 31, 2009 (KR) ..... 10-2009-0081091
Aug. 31, 2009 (KR) ..... 10-2009-0081092

(51) Int. Cl.
*B67D 7/06* (2010.01)

(52) U.S. Cl.
USPC ..... 222/185.1; 222/214; 222/325

(58) Field of Classification Search
USPC ..... 4/628; 206/446, 521, 587, 588, 592; 222/108, 143, 164–166, 184, 185.1, 214, 222/465.1, 466, 325; 211/126.1–126.4, 11, 211/45, 50, 188, 194, 74; 248/146, 148
See application file for complete search history.

(56) References Cited

U.S. PATENT DOCUMENTS 1,017,756 A * 2/1912 Head ..... 222/484
1,886,619 A * 11/1932 Arnone ..... 248/105
1,963,111 A * 6/1934 Backes ..... 222/457
2,560,761 A * 7/1951 Ferguson ..... 211/73
3,194,426 A * 7/1965 Brown, Jr. ..... 220/23.4
4,702,397 A * 10/1987 Gortz ..... 222/211
D328,220 S * 7/1992 Barnard et al. ..... D7/589
5,205,423 A * 4/1993 Ota ..... 215/12.1
D336,005 S * 6/1993 Keup ..... D7/313
5,277,332 A * 1/1994 Rogers ..... 221/96
5,469,708 A * 11/1995 Harrison et al. ..... 62/3.64
5,743,438 A * 4/1998 Sokolnicki ..... 222/181.1
5,827,428 A * 10/1998 Chang ..... 210/248
5,842,606 A * 12/1998 DeVito ..... 222/132
D425,375 S * 5/2000 Parham ..... D7/619.1
6,206,242 B1 3/2001 Amberg et al.
6,223,944 B1 * 5/2001 Gehl et al. ..... 222/94
6,622,892 B2 * 9/2003 Vance ..... 222/143
6,827,243 B1 * 12/2004 Nuzzolese ..... 222/628
7,025,230 B1 * 4/2006 Salmela ..... 222/146.2
7,275,662 B1 * 10/2007 Milcetich ..... 222/185.1
2002/0130133 A1 * 9/2002 Immerman et al. ..... 220/630
2005/0155983 A1 * 7/2005 Robinson et al. ..... 222/143

(Continued)

FOREIGN PATENT DOCUMENTS

CN 1461843 A 12/2003
CN 101307557 A 11/2008

(Continued)

*Primary Examiner* — Kevin P Shaver
*Assistant Examiner* — Patrick M Buechner
(74) *Attorney, Agent, or Firm* — Birch, Stewart, Kolasch & Birch, LLP

(57) ABSTRACT

A detergent container cradle including a seating surface for supporting a detergent container having an outlet for discharging detergent therefrom, and sidewalls provided at opposite edges of the seating surface to apply pressure to an outside circumferential surface of the detergent container having no outlet provided thereto.

17 Claims, 5 Drawing Sheets

U.S. PATENT DOCUMENTS

| | | | | |
|---|---|---|---|---|
| 2005/0161473 | A1* | 7/2005 | Hildreth | 222/181.2 |
| 2006/0179562 | A1* | 8/2006 | Huber | 4/628 |
| 2007/0084253 | A1 | 4/2007 | Ehrlich et al. | |
| 2009/0095750 | A1 | 4/2009 | Vitan et al. | |
| 2012/0292346 | A1* | 11/2012 | Watson et al. | 222/185.1 |

FOREIGN PATENT DOCUMENTS

| | | | |
|---|---|---|---|
| DE | 32 16 151 | A1 | 12/1982 |
| DE | 196 41 750 | A1 | 4/1998 |
| EP | 1 777 332 | A1 | 4/2007 |

* cited by examiner

DETERGENT CONTAINER CRADLE FOR APPLYING PRESSURE TO THE CONTAINER

CROSS REFERENCE TO RELATED APPLICATION

This application claims the benefit of the Patent Korean Application No. 10-2009-0081092, filed on Aug. 31, 2009, the Patent Korean Application No. 10-2009-0081091, filed on Aug. 31, 2009, and the Patent Korean Application No. 10-2009-0081090, filed on Aug. 31, 2009, which are hereby incorporated by reference as if fully set forth herein.

BACKGROUND OF THE DISCLOSURE

1. Field of the Disclosure

The present invention relates to a detergent container cradle.

2. Discussion of the Related Art

In general, a laundering machine is a domestic appliance for removing dirt from laundry by actions of water and detergent.

There are agitator type, pulsator type, and drum type laundering machines. The agitator type laundering machine has a washing pole upright at a center of a washing tub to be rotate in left/right directions for washing, the pulsator type laundering machine has a disc like pulsator on a bottom of the washing tub to be rotated in left/right directions for washing by using friction between a water flow and laundry, and the drum type laundering machine has a drum to be rotated for washing, with water, detergent and laundry placed in the drum.

The laundering machine supplies washing water and detergent to a washing tub or a tub, rotates a drum in the washing tub or the tub, to remove the dirt from the laundry by friction between the washing water and the laundry and a chemical action of the detergent.

In the detergent used in washing, there are powder detergent and liquid detergent according to forms of the detergent, or general detergent decomposing the dirt from the laundry, functional detergent for adding aroma to the laundry, and fabric softener for softening clothes according to purposes of use.

The detergent is provided to the user in a state the detergent is stored in a detergent container, such that the user supplies an amount to the laundering machine every time the user washes the laundry.

SUMMARY OF THE DISCLOSURE

Accordingly, the present invention is directed to a detergent container cradle.

An object of the present invention is to provide a detergent container cradle which can be positioned on a top of a laundering machine for improving convenience of a user.

Another object of the present invention is to provide a detergent container cradle which enables easy discharge of detergent from a detergent container, and to use the detergent in the detergent container completely.

Another object of the present invention is to provide a detergent container cradle which enables to place two or more than two detergent containers thereon.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a detergent container cradle includes a seating surface for supporting a detergent container having an outlet for discharging detergent therefrom, and sidewalls provided at opposite edges of the seating surface to apply pressure to an outside circumferential surface of the detergent container having no outlet provided thereto.

In this case, the seating surface has a width smaller than a width of the outside circumferential surface of the detergent container for press fit of the detergent container between the sidewalls.

And, the sidewalls are provided such that a distance between the sidewalls becomes the greater as the sidewalls go upward the more.

And, the sidewall further includes a projection projected therefrom toward an outside surface direction of the detergent container.

And, the seating surface is provided sloped downward in a direction of the outlet of the detergent container.

In this case, the seating surface further includes a holding step for holding one side of the detergent container having the outlet.

In the meantime, the detergent container cradle further includes a cup holder on a lower side of the outlet of the detergent container for receiving a cup which holds the detergent from the outlet.

In this case, the detergent container cradle further includes a cup holder receiving recess for receiving the cup holder, and the cup holder can be placed in/removed from the cup holder receiving recess.

And, the cup holder includes a base plate having a cup receiving recess for receiving the cup, and the cup receiving recess is a downward recess from the base plate to be in contact with the cup holder receiving recess.

And, the cup holder includes the base plate having the cup receiving recess for receiving the cup, and ribs provided on an underside of the base plate spaced a distance from an outside surface of the base plate toward an inside of the base plate.

The cup holder includes the base plate having the cup receiving recess for receiving the cup, a front flange and a rear flange which are bents from opposite edges of the base plate, respectively, and a side flange which is a bent from at least one edge of the base plate to have a height lower than heights of the front flange and the rear flange.

In the meantime, the detergent container cradle further includes supporting walls provided to opposite edges of the seating surface for supporting the seating surface, and the supporting walls have curved portions bent toward the seating surface, respectively.

In this case, the detergent container cradle further includes an extension from the curved portion to an outside of the supporting wall, the extension having a length the same or greater than thickness of the supporting wall, and a coupling rib which has a bent portion of the extension.

The coupling rib is provided to each of opposite edges of the curved portion and the bent portions are bent in directions opposite to each other.

The supporting wall further includes anti-slip ribs provided to a top side of the curved portion.

In the meantime, the detergent container cradle further includes a work board provided for supporting a bottom of the supporting wall, the work board having a securing portion for securing a position of the supporting wall, and the supporting wall further includes a receiving slot for receiving the securing portion.

In this case, the work board further includes a frame having the securing portion for supporting the supporting wall, and a laundering machine receiver provided on an underside of the frame for receiving a top side of the laundering machine.

The securing portion is a rail provided along a length direction of the frame.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. As far as there are no particular definitions, all terms in the specification are the same with general meanings of the terms understood by persons skilled in this field of art, and, if the term used in the specification conflicts with the general meaning of the term, the meaning of the term used in the specification prevails.

In the meantime, a configuration or a control method of a device described hereinafter is provided only for describing embodiments of the present invention, but not for limiting scope of patent rights of the present invention. Wherever possible, the same reference numbers will be used throughout the drawings to refer to the same or like parts.

Figure 1:
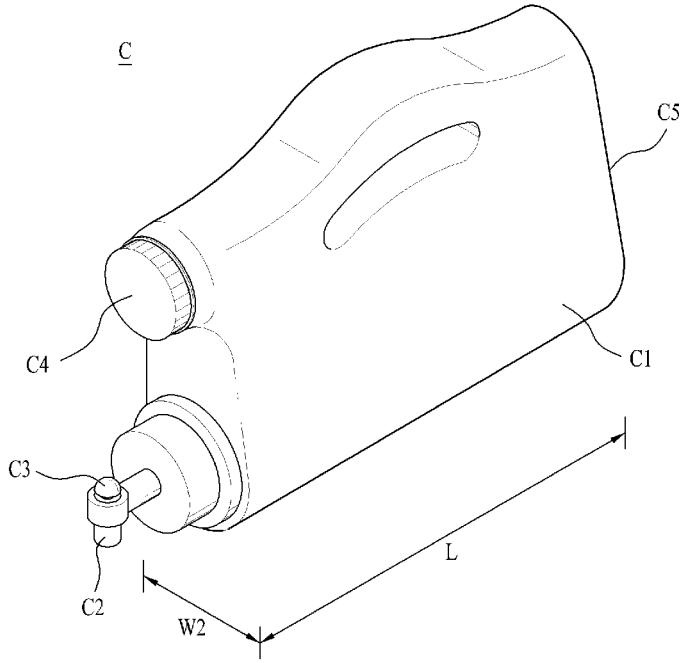
FIG. 1 illustrates a perspective view of an exemplary detergent container.

FIG. 1 illustrates a perspective view of an exemplary detergent container C. The detergent container includes a storage portion C1 for providing a space to store the detergent therein, an outlet C2 in an upper side of the storage portion for discharging the detergent from the detergent container, and a button C3 for selective opening of the outlet. Moreover, if the detergent container C enables refilling of the detergent, it is preferable that the detergent container C includes a refilling cap C4. Since FIG. 1 illustrates only an example of a detergent container provided to the user with the detergent contained therein, the detergent container cradle of the present invention is not limited to a detergent container cradle which includes all of above elements.

Figure 2:
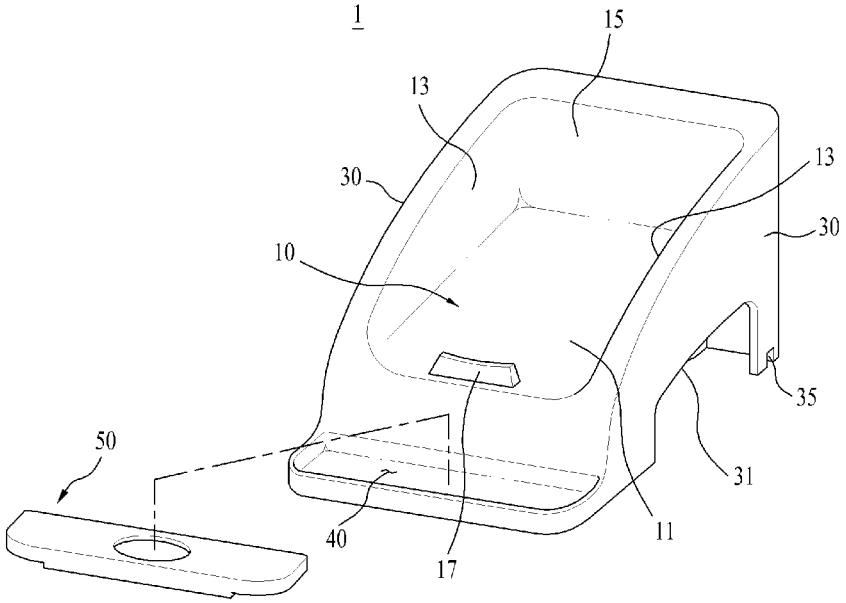
FIG. 2 illustrates a perspective view of a detergent container cradle in accordance with a preferred embodiment of the present invention.
Figure 3:
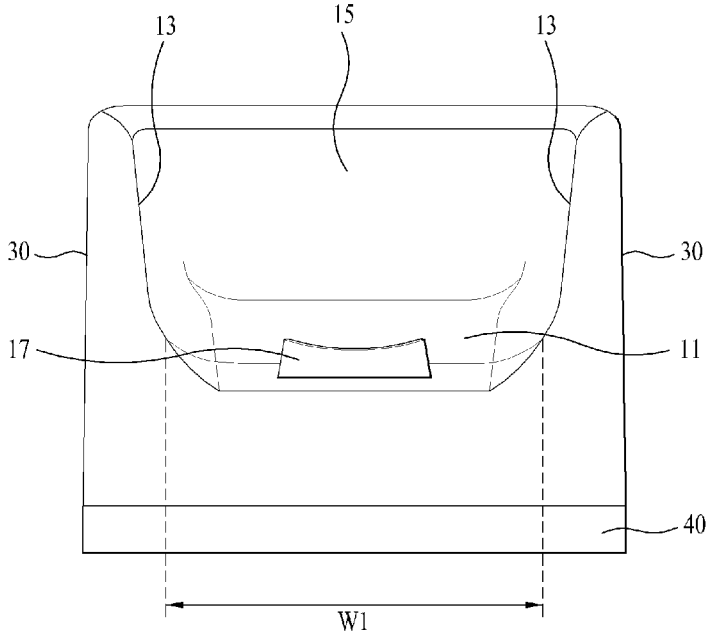
FIG. 3 illustrates a front view of a detergent container cradle in accordance with a preferred embodiment of the present invention.
Figure 4:
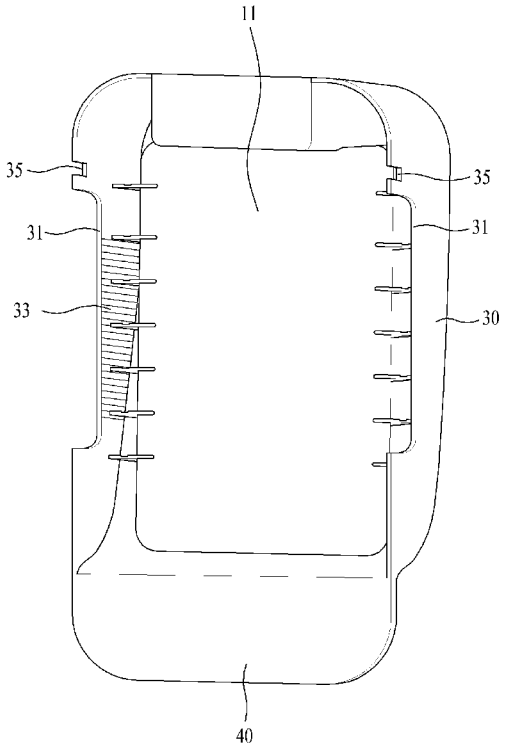
FIG. 4 illustrates a bottom perspective view of a detergent container cradle in accordance with a preferred embodiment of the present invention.

FIG. 2 illustrates a perspective view of a detergent container cradle in accordance with a preferred embodiment of the present invention, FIG. 3 illustrates a front view of a detergent container cradle in accordance with a preferred embodiment of the present invention, and FIG. 4 illustrates a bottom perspective view of a detergent container cradle in accordance with a preferred embodiment of the present invention.

Referring to FIGS. 2 to 3, the detergent container cradle 1 C includes a mounting portion 10 for receiving the detergent container C therein, a supporting wall 30 for supporting the mounting portion 10, and a cup holder 50 (See FIG. 5) in front of a lower side of the mounting portion 10.

The mounting portion 10 can include a seating surface 11 in a detergent container receiving space for supporting one side of the detergent container, and sidewalls 13 which are extensions from opposite edges of the seating surface, respectively.

The seating surface 11 is provided to support an outside circumference of the storage portion C1 of the detergent container C in a length direction L (See FIG. 1) thereof, and the sidewalls 13 are upward extensions from the opposite edges of the seating surface 11 to be able to apply a pressure to the outside circumference of the storage portion of the detergent container supported on the seating surface, respectively.

The sidewalls 13 applies the pressure to the storage portion C1 of the detergent container C for applying a predetermined pressure to the detergent (particularly, the liquid detergent) in the detergent container C. The application of the pressure to the detergent in the detergent container C enables easy discharge of the detergent from detergent container when the user presses the button C3 at the outlet C2.

In order to make the mounting portion 10 to apply the pressure to the outside circumference of the detergent container, the seating surface 11 may be formed to have a width W1 (See FIG. 3) smaller than a width W2 of the detergent container C supported on the seating surface.

Since the sidewalls 13 are upward extensions from the opposite edges of the seating surface 11, if the width W1 of the seating surface is smaller than the width W2 of the detergent container, the detergent container will have the pressure applied thereto in a course of press fit of the detergent container to the mounting portion 10, naturally.

In this case, the sidewalls 13 may be provided such that a distance between the sidewalls 11 becomes the greater as the sidewalls 13 go upward the more. That is, the sidewalls 13 may be provided to be sloped at an angle.

The sidewalls 13 produces, not only an effect of applying the presser to the outside circumference of the detergent container C, but also an effect of making the press fit of the detergent container C easy.

Moreover, the detergent container cradle C of the present invention may have pressure applying projections 131 (See FIG. 10) respectively from the sidewalls 13 for making the pressure application to the outside circumference to the detergent container easier, additionally.

Since it is adequate that the pressure applying projections 131 are provided to have shapes which can apply the pressure to the outside circumference of the storage portion of the detergent container as well as enable the press fit of the detergent container to the mounting portion, the pressure applying projections 131 can be provided projected from the sidewalls 13, respectively.

Figure 10:
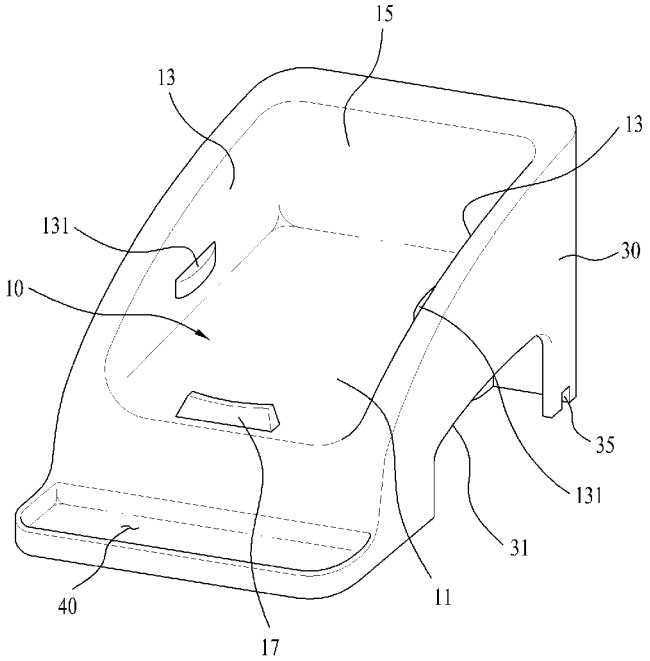
FIG. 10 illustrates a perspective view of a detergent container cradle in accordance with another preferred embodiment of the present invention.

And, referring to FIG. 10, the pressure applying projections 131 may be provided one or more than one in the length direction of the sidewalls 13 respectively. However, though not shown in FIG. 10, the pressure applying projections 131 may be provided in a height direction of the sidewalls 13.

Moreover, it is preferable that the seating surface 11 is sloped downward toward the outlet of the detergent container. That is, in a case the detergent container is mounted to the mounting portion, the seating surface 11 is sloped by a predetermined angle such that the outlet C2 of the detergent container is positioned at a position lower than a bottom surface C5 of the detergent container.

This is for using the detergent completely if a small amount of the detergent is remained in the detergent container.

That is, since the detergent in the storage portion moves toward the outlet C2 if the seating surface 11 is sloped by the predetermined angle, the user can use up all of the liquid detergent stored in the detergent container without any particular effort (efforts, such as shaking the detergent container with the outlet directed downward, or putting the detergent container upside down, and so on).

In the meantime, the mounting portion 10 may include a holding step 17. The holding step 17 is provided to be projected from the seating surface 11 for supporting a side of the detergent container C having the outlet C2 provided thereto.

The holding step 17 prevents the detergent container from sliding down the seating surface 11 by weight of the detergent in the detergent container in the case the seating surface is sloped.

The mounting portion 10 may include a rear wall 15 for receiving a bottom surface C5 of the detergent container, additionally. The rear wall 15 may be provided to be spaced from the bottom surface C5 of the detergent container, or to apply a pressure to the bottom surface of the detergent container.

The provision of the rear wall 15 to be spaced from the bottom surface C5 of the detergent container is for providing a mounting portion 10 which can receive a detergent container of various sizes, and the provision of the rear wall 15 to apply a pressure to the bottom surface of the detergent container is for applying a pressure to the detergent in the detergent container. In a latter case, an additional pressure applying projection (not shown) may be provided to the rear wall such that the bottom surface of the detergent container is press fit to the pressure applying projection when the detergent container is mounted to the mounting portion 10.

In addition to the mounting portion 10, the detergent container cradle of the present invention may have a supporting wall 30 for supporting the mounting portion 10.

The supporting wall 30 is downward extensions of the sidewalls 13 and the rear wall 15 such that the seating surface 11 is supported on a floor on which the detergent container cradle is placed.

In the meantime, the supporting wall 30 may also include a curved portion 31 in the bottom surface of the detergent container cradle which is in contact with the floor on which the detergent container cradle is placed, and a receiving slot 35 spaced from the curved portion, additionally.

The curved portion 31 serves as a handle when the user moves the detergent container cradle. Therefore, the curved portion 31 may be provided to only one of the two supporting walls opposite across the seating surface 11.

However, when two or more than two detergent container cradles are provided, the curved portion 31 can serve as a coupling portion which couples the detergent container cradle to another detergent container cradle together (will be described later in detail). In this case, it is preferable that the curved portion 31 is provided to each of opposite supporting walls.

Since the curved portion 31 serves as a handle when the user moves the detergent container cradle, the supporting wall 30 may have anti-slip ribs 33 provided adjacent to the curved portion, additionally.

FIG. 4 illustrates a bottom perspective view of a detergent container cradle in accordance with a preferred embodiment of the present invention, referring to which the anti-slip rib 33 will be described. The anti-slip ribs 33 are provided along an outside circumference of the curved portion 31 on an inside surface of the supporting wall 30 which is invisible from an outside of the detergent container cradle. Particularly, it is preferable that the anti-slip ribs 33 are provided concentrated on a horizontal portion of the curved portion 31 at which a user's hand comes into touch when the user moves the detergent container cradle. Accordingly, even if the user's hand is wet, slipping of the user's hand which is moving the detergent container cradle 1 can be prevented.

The receiving slot 35 in the supporting wall 30 is a portion for receiving a securing portion 73 (See FIG. 9) at a work board 70 to be described later.

It is preferable that the detergent container cradle 1 is provided adjacent to a laundering machine, such as a dryer D (See FIG. 9), or a washing machine W (See 9), in view of convenience of the user. However, since a general laundering machine has no provision for securing the detergent container cradle thereto, if the work board is placed on a top of the laundering machine, on which the user touches up the laundry, such as putting the laundry in order or pressing the laundry, and the securing portion 73 is provided to the work board for securing the detergent container cradle 1 thereto, permitting the user to reduce inconvenience of looking for the detergent container at the time of washing and to have a space for putting the laundry in order and touching up the laundry, user's convenience can be improved (the work board will be described, later in detail).

In the meantime, the detergent container cradle 1 of the present invention may include a cup holder receiving recess 40 (See FIG. 2) in front of the mounting portion 10, additionally.

The cup holder receiving recess 40 is a recess provided at a position lower than the seating surface 11 of the mounting portion 10 for receiving the cup holder 50 to be described later therein. Accordingly, it is preferable that the cup holder receiving recess 40 has a shape in conformity with an outside circumferential surface of the cup holder 50. FIG. 2 illustrates the cup holder receiving recess 40 for receiving the cup holder 50 of a substantially hexahedral shape.

In the meantime, since the positions and the shapes of the mounting portion 10, the supporting wall 30, and the cup holder receiving recess 40 are exemplary, variations and modification can be made.

For an example, the detergent container cradle may have a hexahedral body with an opened bottom, and a mounting portion which is a recess in a top side of the body.

In this case, the seating surface 11, the sidewalls and the rear wall 15 of the mounting portion will be replaced with respective sides of a space formed as the top side is recessed.

And, since the supporting wall 30 in FIG. 2 will be replaced with the outside circumferential surface of the body, the curved portion 31 and so on in the supporting wall will be provided to an outside circumferential surface of the body.

Moreover, it is not necessary that the shape of the body and the shapes of the sidewalls and the rear wall are limited to the hexahedral shape as far as the rear wall and the sidewalls are provided to open a bottom surface of the body, but may vary with shapes of the detergent container.

Figure 5:
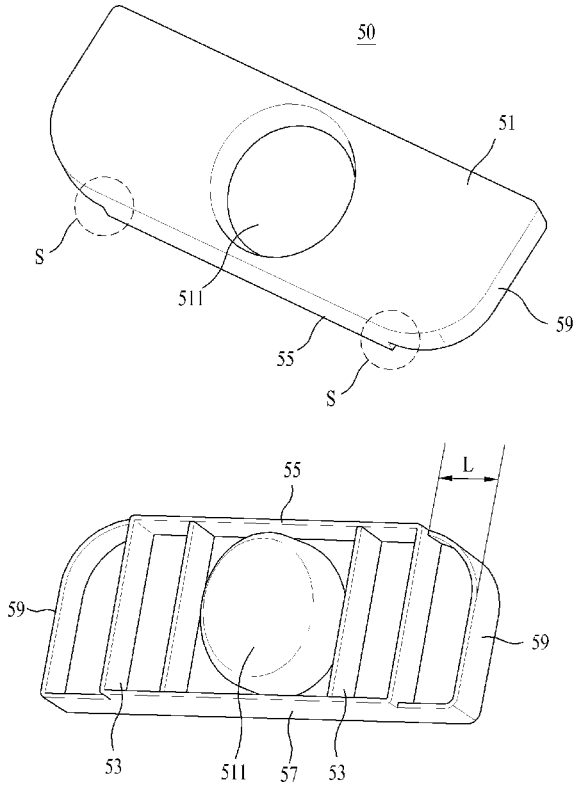
FIG. 5 illustrates a perspective view of a cup holder.

The cup holder 50 provided to the detergent container cradle 1 of the present invention will be described, with reference to FIG. 5.

The cup holder 50 is provided under the outlet of the detergent container for supporting a cup (not shown) for holding the detergent from the outlet of the detergent container. Therefore, as far as the cup holder 50 can support the cup (not shown) and can be received in the cup holder receiving recess 40, the cup holder 50 can have different shapes. However, for convenience's sake, the cup holder 50 will be described, taking a hexahedral cup holder 50 as an example.

The cup holder 50 may be a base plate 51 having a cup receiving recess 511.

It is preferable that the base plate 51 has a shape in conformity with an outside circumferential surface of the cup holder receiving recess 40, and the cup receiving recess 511 is provided in the base plate bent toward the cup holder receiving recess for receiving the cup to measure an amount of detergent required for washing.

Since the cup receiving recess 511 bent down from the base plate, the cup receiving recess 511 can act as a supporting point of a lever when the cup holder 50 is removed from the cup holder receiving recess 40.

That is, in a case the detergent or a foreign matter is in the cup holder receiving recess 40, it is necessary to remove the cup holder 50 from the cup holder receiving recess for cleaning the cup holder receiving recess 40. At the time the user intends to remove the cup holder 50 from the cup holder receiving recess, the user can remove the cup holder 50 from the cup holder receiving recess easily just by pressing one side of the base plate 51 since the cup receiving recess 511 serves as a supporting point.

In the meantime, the cup holder 50 may have ribs 53 on an underside of the base plate 51, additionally.

It is preferable that the ribs 53 are downward extensions from the base plate 51 toward the cup holder receiving recess 40, such that the base plate is supported on a bottom surface of the cup holder receiving recess.

In this instance, it is preferable that at least two ribs 53 are provided on both sides of the cup receiving recess 511, with a height the same or greater than a depth of the cup receiving recess 511. However, it is preferable that the ribs 53 are provided spaced a predetermined distance L from edges of the base plate 51 to an inside of the base plate.

This is for removing the cup holder 50 from the cup holder receiving recess 40 easily since the ribs 53 serve as a supporting point when the cup holder 50 is removed from the cup holder receiving recess 40.

That is, if the ribs 53 have a height smaller than the depth of the cup receiving recess 511, though the cup receiving recess 511 serves as the supporting point, if the ribs 53 have a height greater than the depth of the cup receiving recess 511, since the ribs serve as the supporting point of the lever if the user presses the outside surface of the base plate, the cup holder 50 can be removed from the cup holder receiving recess 40 easily.

In the meantime, besides above effects, a plurality of the ribs 53 may be provided to the underside of the base plate for reinforcing strength of the cup holder 50 and improving processability (injection molding or the like) of the cup holder 50.

In the meantime, the cup holder 50 may include a front flange 55 and a rear flange 57 respectively provided to a front outside surface and a rear outside surface of the base plate for holding the base plate 51 in the cup holder receiving recess 40 securely, additionally.

However, it is preferable that the flanges have heights greater or the same with the heights of the ribs such that the flanges do not inhibit a function of the ribs 53. Moreover, the cup holder 50 may include side flanges 59 which connect the front flange 55 to the rear flange 57, additionally.

In this case, the side flanges 59 are provided to have heights smaller than the heights of the front flange and the rear flange to have steps S at both ends of the cup holder 50.

Since the user can remove the cup holder 50 from the cup holder receiving recess 40 easily by pressing the base plate having the step portion S formed thereon, an effect the ribs 53 produce can be maintained even if the front flange, the rear flange and the side flanges 59 are provided to the cup holder 50.

In the meantime, in a case of the cup holder 50 which forms the step portions S with the front flange, the rear flange and the side flanges, if the strength and the processability of the base plate does not matter, the ribs 53 may be omitted from the underside of the base plate 51.

Figure 6:
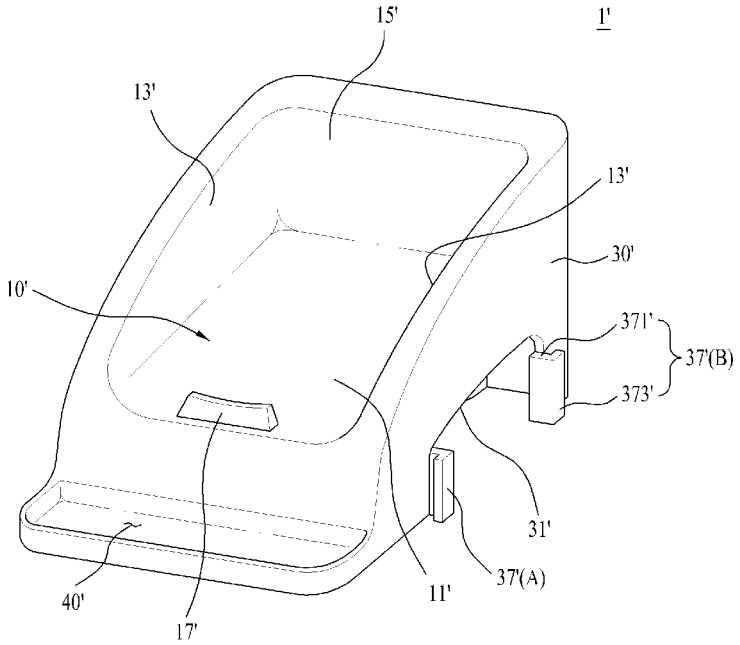
FIG. 6 illustrates a perspective view of a detergent container cradle in accordance with another preferred embodiment of the present invention.
Figure 7:
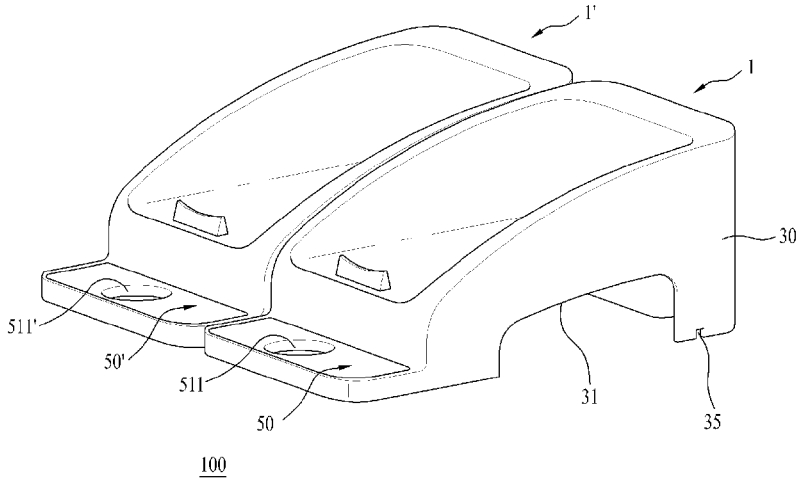
FIG. 7 illustrates a separated perspective view of a detergent container cradle in accordance with another preferred embodiment of the present invention.

FIG. 6 illustrates a perspective view of a detergent container cradle in accordance with another preferred embodiment of the present invention, and FIG. 7 illustrates a perspective view showing the detergent container cradle 1 (a first detergent container cradle) in FIG. 2 and the detergent container cradle 1' (a second detergent container cradle) in FIG. 6 coupled together. A detergent container cradle in accordance with another preferred embodiment of the present invention will be described with reference to FIGS. 6 and 7.

In general, in the detergent used in washing, not only the detergent for removing dirt, but also, according to user's liking, fabric softener, or aroma additive detergent may be used additionally. Accordingly, the embodiment provides a detergent container cradle if two or more than two kinds of detergent are used in washing.

The second detergent container cradle shown in FIG. 6 has a coupling rib for coupling to the first detergent container cradle in FIG. 2, additionally. For convenience's sake, though the first detergent container cradle and the second detergent container cradle are given different names, the two detergent container cradles are the same except the coupling rib. Therefore, the second detergent container cradle 1' will be described focused on a difference of the second detergent container cradle from the detergent container cradle shown in FIG. 2.

The second detergent container cradle 1' has a coupling rib 37' on a supporting wall 30'. The coupling rib 37' may include an extension 371' from a curved portion 31' to an outside of the supporting wall 30', and a bent portion 373' bent from the extension.

In this case, it is preferable that the extension 371' has a length greater than or the same with thickness of the curved portion 31' from the curved portion 31' to an outside of the supporting wall 30'.

This is for making the curved portion 31 or 31' can be placed in a space provided by the extension 371' and the bent portion 373' in a case the first detergent container cradle and the second detergent container cradle are coupled together or the second detergent container cradles are coupled together.

In the meantime, it is preferable that a coupling rib is provided to each of opposite ends of the curved portion 31' (a front coupling rib A and a rear coupling rib B), with the bent portion 373' of each of the coupling ribs bent in opposite directions.

Accordingly, the user having two or more than two second detergent container cradles 1' can couple the two or more than two second detergent container cradles 1' by placing the curved portion 31' of the second detergent container cradle to the coupling rib of another second detergent container cradle.

However, if two or more than two second detergent container cradles are coupled together, the coupling rib 37' is projected from the supporting wall 30' making a poor appearance. Such a problem can be solved by coupling the first detergent container cradle 1 with the second detergent container cradle 1'.

That is, referring to FIG. 7, if both ends of the curved portion 31 of the first detergent container cradle 1 are placed in the coupling rib 37' of the second detergent container cradle 1', the poor appearance caused by the projection of the coupling rib to an outside of the supporting wall 30 can be prevented. In this case, it is preferable that the extension 371' of the coupling rib has a length greater than or the same with thickness of the curved portion 31 of the first detergent container cradle 1.

As described before, if it is a case of a compound detergent container cradle 100 in which the second detergent container cradles for the detergent containers 1' are coupled together, or a compound detergent container cradle 100 in which the first detergent container cradle 1 and the second detergent container cradle 1' are coupled together, the coupling rib may be provided to only one side of the supporting wall 30'.

However, different from FIG. 6, the coupling rib 37' may be provided to each of left/right side supporting walls 30' of the second detergent container cradle 1'. In this instance, since the first detergent container cradle can be coupled to each side of the second detergent container cradle, the poor appearance caused by the coupling rib can be prevented, and a space for mounting the detergent container can be made larger.

Coupling of the first detergent container cradle 1 and the second detergent container cradle 1' will be described with reference to FIGS. 7 and 8.

The compound detergent container cradle 100 in which the first detergent container cradle 1 and the second detergent container cradle 1' are coupled together is made by the curved portion 31 of the detergent container cradle in FIG. 2 and the coupling rib 37' of the detergent container cradle 1' in FIG. 6.

Figure 8:
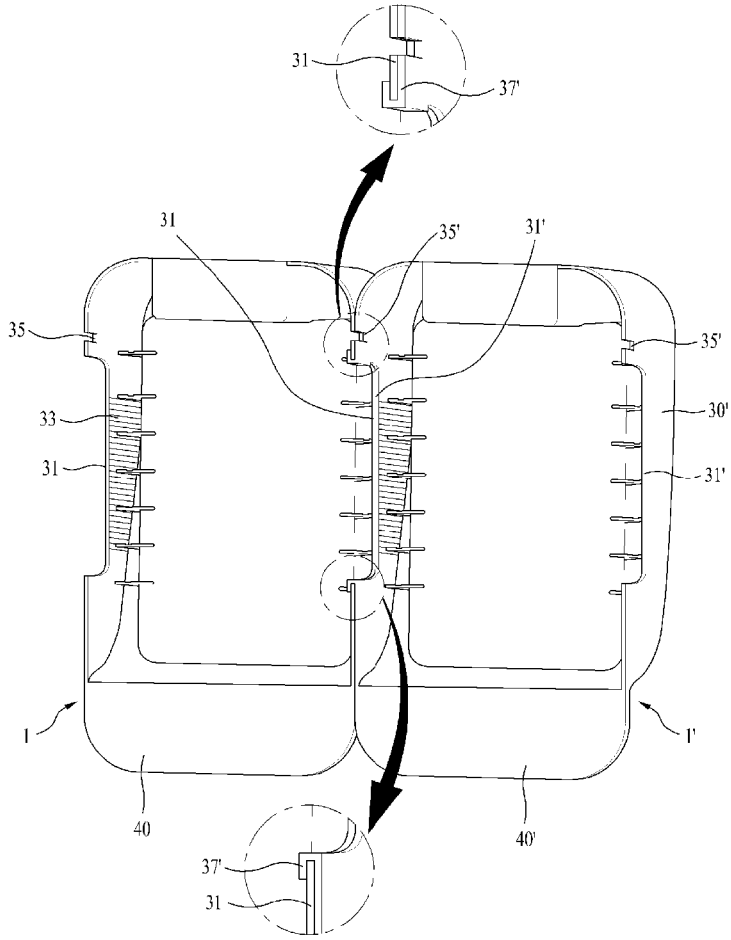
FIG. 8 illustrates a backside view of a detergent container cradle in accordance with another preferred embodiment of the present invention.

Referring to FIG. 8, both ends of the curved portion 31 of the first detergent container cradle 1 having no coupling rib 37' formed thereon are placed in the front and rear ribs A and B (see FIG. 6) of the second detergent container cradle 1' having the coupling portion 37' formed thereon. That is, in a state the supporting wall 30 having the curved portion 31 of the first detergent container cradle 1 provided thereto and the supporting wall 30' of the second detergent container cradle 1' are put close to each other, if the first detergent container cradle 1 is pushed down such that both ends of the curved portion of the first detergent container cradle 1 are placed in the front and rear ribs A and B, the first detergent container cradle 1 is coupled to the second detergent container cradle 1'.

According to this, the curved portions 31 and 31' function as handles when the detergent container cradle is moved, and function as coupling portions when two or more than two detergent container cradles are coupled.

Figure 9:
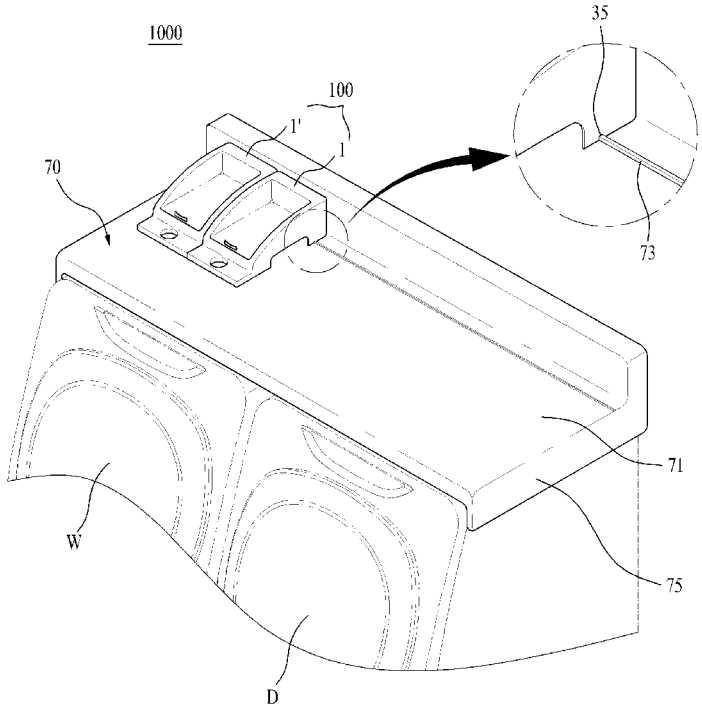
FIG. 9 illustrates a perspective view of a detergent container cradle in accordance with another preferred embodiment of the present invention.

FIG. 9 illustrates a perspective view of a detergent container cradle 1000 in accordance with another preferred embodiment of the present invention. The detergent container cradle 1000 includes a work board 70 provided to a top of the laundering machine D and W, additionally.

Though FIG. 9 illustrates a compound detergent container cradle 100 supported on the work board 70, the detergent container cradle 1000 may only have the first detergent container cradle 1 and the work board 70 or the second detergent container cradle 1' and the work board 70.

The embodiment will be described focusing on the work board 70 with reference to FIG. 9.

The work board 70 is provided on the top of the laundering machine (a washing machine W and a dryer D) for providing a space for the user to touch-up the laundry. The user may make pretreatment of the laundry, such as sorting of the laundry, or applying the detergent to old, set dirt for removal of the old, set dirt. The user may also make post treatment, such as pressing after washing.

Therefore, the work board 70 may include a frame 71 which forms an exterior thereof and is used for seating the detergent container cradles 1 and 1', a securing portion 73 which is a projection from the top surface of the frame 71, and a laundering machine receiver 75 for receiving a top side of the laundering machines D and W, for providing a working space required for treating the laundry before and after the washing.

Though FIG. 9 illustrates the work board 70 which can receive top sides of the washing machine W and the dryer D if the washing machine W and the dryer D are installed side by side, the present invention does not exclude a work board which can be provided only to a top side of the washing machine or the dryer.

The securing portion 73 is a projection from the top surface of the frame 71, for securing a position of the detergent container cradle as the securing portion 73 is placed in the receiving slots 35 and 35' in the detergent container cradles 1 and 1'.

In the meantime, the securing portion 73 may have a rail shape formed along a length direction of the frame 71. The rail shaped securing portion 73 enables the detergent container cradle to move on the top surface of the frame 71 in left/right directions when the drawing is seen from above, permitting the user to place the detergent container cradle at a desired position.

It is adequate that the laundering machine receiver 75 is provided on an underside of the frame 71 to have a shape that can receive the top side of the laundering machine. The laundering machine receiver 75 shown in FIG. 9 having downward bents at opposite sides of the frame 71 may be one of examples.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A detergent container cradle comprising:

a seating surface for supporting a detergent container having an outlet for discharging detergent therefrom; and sidewalls provided at opposite edges of the seating surface to apply pressure to an outside circumferential surface of the detergent container having no outlet provided thereto, wherein the seating surface has a width smaller than a width of the outside circumferential surface of the detergent container for press fit of the detergent container between the sidewalls, and wherein the application of pressure to the detergent container applies a predetermined pressure to the detergent in the detergent container to assist in discharging of the detergent.

2. The detergent container cradle as claimed in claim 1, wherein the sidewalls are provided such that a distance between the sidewalls becomes greater as the sidewalls go upward more.

3. The detergent container cradle as claimed in claim 1, wherein the sidewalls further include a projection projected therefrom toward an outside surface direction of the detergent container.

4. The detergent container cradle as claimed in claim 1, wherein the seating surface is provided sloped downward in a direction of the outlet of the detergent container.

5. The detergent container cradle as claimed in claim 4, wherein the seating surface further includes a holding step for holding one side of the detergent container having the outlet.

6. The detergent container cradle as claimed in claim 1, further comprising a cup holder on a lower side of the outlet of the detergent container for receiving a cup which holds the detergent from the outlet.

7. The detergent container cradle as claimed in claim 6, further comprising a cup holder receiving recess for receiving the cup holder, and the cup holder can be placed in/removed from the cup holder receiving recess.

8. The detergent container cradle as claimed in claim 7, wherein the cup holder includes a base plate having a cup receiving recess for receiving the cup, and the cup receiving recess is a downward recess from the base plate to be in contact with the cup holder receiving recess.

9. The detergent container cradle as claimed in claim 7, wherein the cup holder includes:

the base plate having the cup receiving recess for receiving the cup; and ribs provided on an underside of the base plate spaced a distance from an edge of the base plate toward an inside of the base plate.

10. The detergent container cradle as claimed in claim 7, wherein the cup holder includes:

the base plate having the cup receiving recess for receiving the cup;

a front flange and a rear flange which are bents from opposite edges of the base plate, respectively; and a side flange which is a bent from at least one edge of the base plate to have a height lower than heights of the front flange and the rear flange.

11. The detergent container cradle as claimed in claim 1, further comprising supporting walls provided to opposite edges of the seating surface for supporting the seating surface; and the supporting walls have curved portions bent toward the seating surface, respectively.

12. The detergent container cradle as claimed in claim 11, further comprising an extension from the curved portion to an outside of the supporting wall, the extension having a length the same or greater than a thickness of the supporting wall, and a coupling rib which has a bent portion of the extension.

13. The detergent container cradle as claimed in claim 12, wherein the coupling rib is provided to each of opposite edges of the curved portion and the bent portions are bent in directions opposite to each other.

14. The detergent container cradle as claimed in claim 12, wherein the supporting wall further includes anti-slip ribs provided to a top side of the curved portion.

15. The detergent container cradle as claimed in claim 11, further comprising a work board provided for supporting a bottom of the supporting walls, wherein the supporting walls further include a receiving slot provided at the bottom portion of each of the supporting walls, and wherein the work board further includes a securing portion which is inserted into the receiving slot for securing a position of the supporting walls.

16. The detergent container cradle as claimed in claim 15, wherein the work board further includes:

a frame having the securing portion for supporting the supporting wall; and a laundering machine receiver provided on an underside of the frame for receiving a top side of the laundering machine.

17. The detergent container cradle as claimed in claim 16, wherein the securing portion is a rail provided along a length direction of the frame.

* * * * *